US007392849B2

(12) United States Patent
Lauderdale et al.

(10) Patent No.: US 7,392,849 B2
(45) Date of Patent: Jul. 1, 2008

(54) BALANCE LINE SAFETY VALVE WITH TUBING PRESSURE ASSIST

(75) Inventors: Donald Powell Lauderdale, Cypress, TX (US); Roddie R. Smith, Cypress, TX (US); Richard Gledhill, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 333 days.

(21) Appl. No.: 11/069,781

(22) Filed: Mar. 1, 2005

(65) Prior Publication Data

US 2006/0196669 A1 Sep. 7, 2006

(51) Int. Cl.
*E21B 34/10* (2006.01)

(52) U.S. Cl. ..... 166/375; 166/386; 166/324; 166/332.8

(58) Field of Classification Search ..... 166/375, 166/386, 321, 324, 332.8
See application file for complete search history.

(56) References Cited

U.S. PATENT DOCUMENTS

| | | | | |
|---|---|---|---|---|
| 4,597,445 | A | 7/1986 | Knox | |
| 4,621,695 | A | 11/1986 | Pringle | |
| 4,624,315 | A | 11/1986 | Dickson et al. | |
| 4,834,183 | A | 5/1989 | Vinzant et al. | |
| 4,945,993 | A | 8/1990 | Dickson et al. | |
| 5,125,457 | A | 6/1992 | Meaders | |
| 5,145,005 | A | 9/1992 | Dollison | |
| 5,167,284 | A | 12/1992 | Leismer | |
| 5,199,494 | A | 4/1993 | Williamson, Jr. | |
| 5,249,630 | A | 10/1993 | Meaders et al. | |
| 5,259,457 | A | 11/1993 | Williamson, Jr. | |
| 5,293,943 | A | 3/1994 | Williamson, Jr. | |
| 5,343,955 | A | 9/1994 | Williams | |
| 5,358,053 | A | 10/1994 | Akkerman | |
| 5,415,237 | A * | 5/1995 | Strattan | 166/375 |
| 5,564,501 | A * | 10/1996 | Strattan et al. | 166/375 |

(Continued)

FOREIGN PATENT DOCUMENTS

EP 1006259 A2 * 6/2000

(Continued)

OTHER PUBLICATIONS

Halliburton Energy Services, Inc., Wellstar™, Tubing Retrievable Subsurface Safety Valve, 4 pp. (1997).

(Continued)

*Primary Examiner*—Jennifer H Gay
*Assistant Examiner*—Robert E Fuller
(74) *Attorney, Agent, or Firm*—Patterson & Sheridan, L.L.P.

(57) ABSTRACT

The present invention generally relates to a subsurface safety valve configured to control fluid flow through a production tubing string. In one aspect, a safety valve for deployment beneath a surface of a wellbore is provided. The valve includes a control piston and a balance piston. The valve is configured to be connected to a controller at the surface by a control line so that the control piston is actuatable between a first position and a second position in response to receiving pressurized fluid from the controller through the control line. The balance piston is configured to compensate for hydrostatic pressure in the control line. The valve may have a bore therethrough and the control piston may be configured to utilize tubing pressure within the valve bore to urge the control piston towards the second position.

20 Claims, 7 Drawing Sheets

U.S. PATENT DOCUMENTS

| | | | | |
|---|---|---|---|---|
| 5,564,502 | A | 10/1996 | Crow et al. | |
| 5,682,921 | A | 11/1997 | Rawson et al. | |
| 5,799,949 | A | 9/1998 | Beall et al. | |
| 5,823,265 | A | 10/1998 | Crow et al. | |
| 5,918,858 | A | 7/1999 | Rawson et al. | |
| 6,003,605 | A * | 12/1999 | Dickson et al. | 166/375 |
| 6,056,055 | A | 5/2000 | Falconer et al. | |
| 6,109,351 | A | 8/2000 | Beall | |
| 6,173,785 | B1 | 1/2001 | Adams et al. | |
| 6,260,850 | B1 | 7/2001 | Beall et al. | |
| 6,263,910 | B1 | 7/2001 | Davis et al. | |
| 6,283,477 | B1 | 9/2001 | Beall | |
| 6,296,061 | B1 | 10/2001 | Leisner | |
| 6,302,210 | B1 | 10/2001 | Crow et al. | |
| 6,328,062 | B1 | 12/2001 | Williams et al. | |
| 6,378,610 | B2 | 4/2002 | Rayssiguier et al. | |
| 6,513,594 | B1 * | 2/2003 | McCalvin et al. | 166/320 |
| 6,659,185 | B2 | 12/2003 | Dennistoun et al. | |
| 6,666,271 | B2 | 12/2003 | Deaton et al. | |
| 6,776,240 | B2 | 8/2004 | Kenison et al. | |
| 6,851,477 | B2 | 2/2005 | Hill, Jr. et al. | |
| 6,854,519 | B2 | 2/2005 | Deaton et al. | |
| 6,880,641 | B2 | 4/2005 | Dennistoun et al. | |
| 2002/0040788 | A1 | 4/2002 | Hill | |
| 2002/0074129 | A1 * | 6/2002 | Moore | 166/375 |
| 2004/0007365 | A1 | 1/2004 | Hill et al. | |
| 2004/0154803 | A1 | 8/2004 | Anderson et al. | |
| 2005/0061519 | A1 | 3/2005 | Wagner et al. | |
| 2005/0077050 | A1 | 4/2005 | McKay | |

FOREIGN PATENT DOCUMENTS

| | | |
|---|---|---|
| GB | 2213181 | 8/1989 |
| WO | WO 99/14461 | 3/1999 |
| WO | WO 03/054347 | 7/2003 |
| WO | WO 2004/022906 | 3/2004 |

OTHER PUBLICATIONS

Halliburton Energy Services, Inc., product brochure for WellStar™, Tubing-Retrievable Safety Valve, pp. 6-13 (2004).
U.S. Appl. No. 10/779,478.
U.S. Appl. No. 10/957,240.
Optimax: The "Missing Link", www.weatherford.com.
Surface-Controlled, Flapper-Type Subsurface Safety Valves, www.weatherford.com.
Preliminary Examination and Search Report, Application No. GB0604052.1, dated Jul. 3, 2006.

* cited by examiner

BALANCE LINE SAFETY VALVE WITH TUBING PRESSURE ASSIST

BACKGROUND OF THE INVENTION

1. Field of the Invention

Embodiments of this invention are generally related to safety valves. More particularly, embodiments of this invention pertain to subsurface safety valves configured to control fluid flow through a production tubing string.

2. Description of the Related Art

Safety Valves are designed to minimize the loss of reservoir resources or production equipment resulting from catastrophic subsurface events by shutting in the well. The "standard" safety valve achieves this by design with one "active control line". The normally closed safety valves are controlled from the surface via a hydraulic control line that extends from the valve, through the wellhead to a surface controlled emergency closure system. Hydraulic pressure $P_C$ applied through the control line maintains the valve in the opened position. Removal of control line pressure returns the valve to its normally closed position. Setting depth directly affects the operational characteristics of the valve due to the hydrostatic pressures $P_H$ created from the normal control system.

Conventional safety valve design incorporates a hydraulic piston and spring to open and close the valve. The hydraulic chamber housing the piston is connected to the surface by a hydraulic control line. Pressure is applied to this control line to hold the valve in the open position. Hydrostatic or "head" pressure $P_H$ is always present in the control line due to the column of fluid between the safety valve and the surface.

Functionally, control line pressure $P_C$ actuates a piston which is mechanically linked to a "flow tube". The flow tube traverses across a closed flapper thus opening the flow through the safety valve and its tubing. When the surface pressure is released, a return spring returns the valve back to its closed position. The nature of the design is such that the tubing pressure $P_T$, which acts against the active control line piston effect, will assist in valve closure.

To open the valve, hydraulic pressure $P_C$ is applied to the upper end of the piston, via the control line, forcing the flow tube downward, opening the flapper.

To close the valve, the applied hydraulic pressure $P_C$ is removed from the upper end of the piston. There are two forces available now to force the flow tube upward allowing the flapper to close. The spring now furnishes an upward force $F_S$ sufficient to counteract the downward force due to the hydrostatic pressure $P_H$ of the fluid in the hydraulic control line. This causes the flow tube to move upward allowing the flapper to close. Tubing pressure $P_T$ at the safety valve will also apply an upward force on the hydraulic piston. This will assist the piston in the upward movement of the flow tube allowing the flapper to close.

In a deep set application, the active control line hydrostatic pressure $P_H$ is significant, such that a spring may not be able to overcome the hydrostatic pressure, thus not allowing the flapper to close. To compensate for the active control line's hydrostatic pressure $P_H$, a second "balance" line is used to negate the affect of hydrostatic pressure $P_H$ from active control line. In existing balance line valves, the second line acts on the underside of the piston, to balance the hydrostatic pressure $P_H$. However, in this design, since the underside of the piston is in fluid communication with the balance line, it is no longer in fluid communication with the tubing; thereby the beneficial effect of the tubing pressure $P_T$ is not utilized.

Therefore, there is a need for a safety valve that balances the control line hydrostatic pressure $P_H$ while still utilizing the tubing pressure $P_T$ to aid in closure of the valve.

SUMMARY OF THE INVENTION

The present invention generally relates to a subsurface safety valve configured to control fluid flow through a production tubing string. In one aspect, a safety valve for deployment beneath a surface of a wellbore is provided. The valve includes a control piston and a balance piston. The valve is configured to be connected to a controller at the surface by a control line so that the control piston is actuatable between a first position and a second position in response to receiving pressurized fluid from the controller through the control line. The balance piston is configured to compensate for hydrostatic pressure in the control line. The valve may have a bore therethrough and the control piston may be configured to utilize tubing pressure within the valve bore to urge the control piston towards the second position.

In another aspect, a subsurface safety valve is provided. The valve includes a flow tube having a bore therethrough; a control piston having two sides isolated from each other by a seal assembly and coupled to the flow tube; and a balance piston having two sides isolated from each other by a seal assembly and selectively coupled to the flow tube. The valve is configured so that the control piston will receive a control pressure on the first side and the balance piston will receive a hydrostatic pressure on the second side.

The flow tube may be actuatable between a first position and a second position and the balance piston may be selectively coupled to the flow tube so that the balance piston may urge the flow tube towards the second position but not towards the first position. The second side of the control piston may be in fluid communication with the flow tube bore. The second side of the balance piston may be in fluid communication with the flow tube bore. The valve may further include at least one housing, wherein the flow tube, the control piston, and the balance piston are disposed within the housing and the balance piston may be selectively coupled to the housing. The valve may further include a flapper coupled to the housing and a flapper spring coupled between the flapper and the housing, wherein the flapper may be actuatable by the flow tube between a first position and a second position and the flapper spring biases the flapper in the second position.

In another aspect, a subsurface safety valve is provided. The valve includes a control piston configured to open the valve by receiving pressurized fluid from a control line and means for compensating for hydrostatic pressure in a control line to the valve while utilizing tubing pressure within the valve to assist in closure of the valve.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
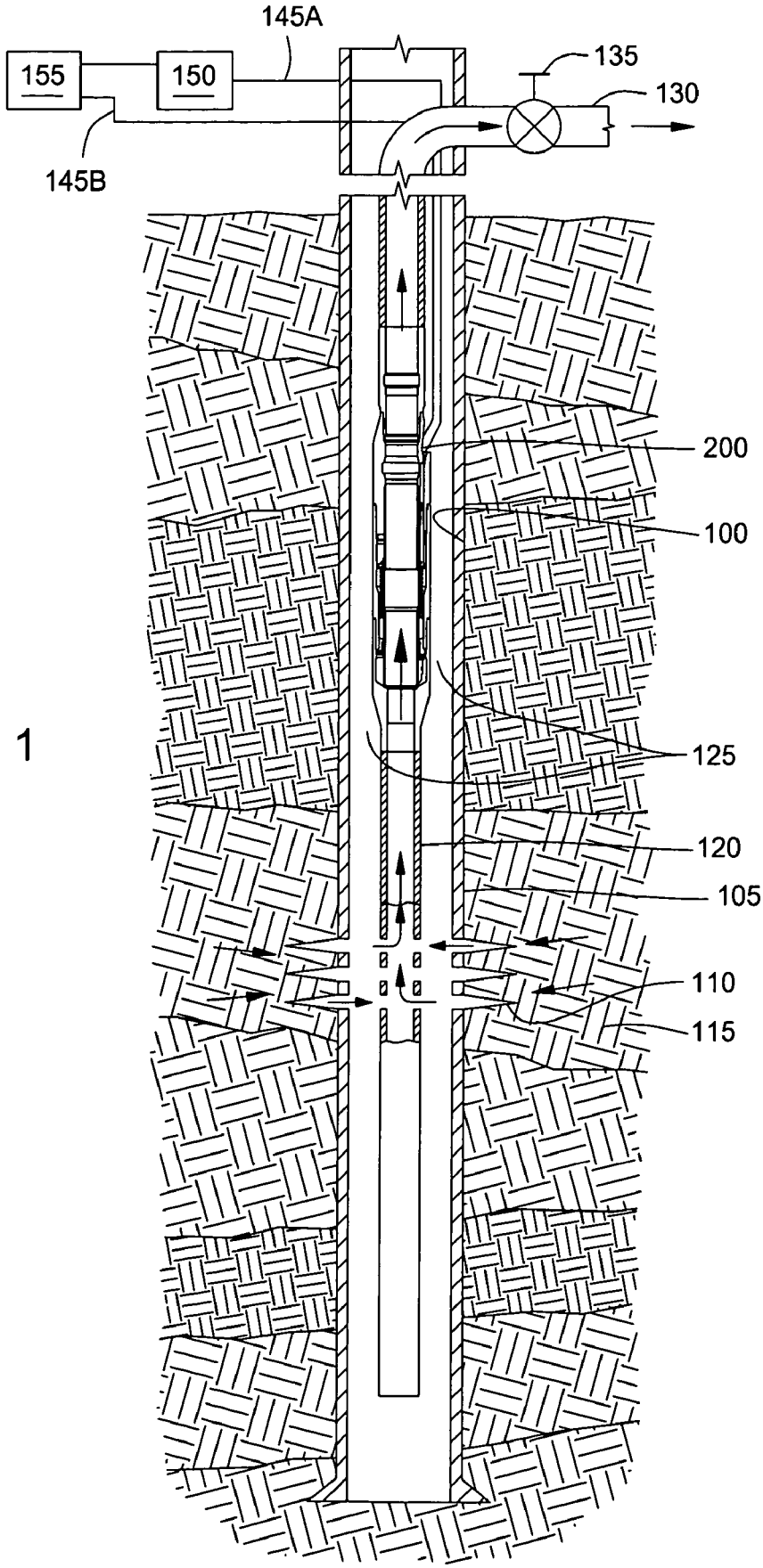
FIG. 1 is a view illustrating a production tubing having a safety valve assembly in accordance with an embodiment of the present invention.

The present invention is generally directed to a subsurface safety valve assembly for controlling fluid flow in a wellbore. To the extent a term used in a claim is not defined below, it should be given the broadest definition persons in the pertinent art have given that term, as reflected in printed publications and issued patents. In the description that follows, like parts are marked throughout the specification and drawings with the same reference numerals. The drawings may be, but are not necessarily, to scale and the proportions of certain parts have been exaggerated to better illustrate details and features of the invention. One of normal skill in the art of subsurface safety valves will appreciate that the various embodiments of the invention can and may be used in all types of subsurface safety valves, including but not limited to tubing retrievable or wireline retrievable valves.

For ease of explanation, the invention will be described generally in relation to a cased vertical wellbore. It is to be understood; however, that the invention may be employed in an open wellbore, a horizontal wellbore, or a diverging wellbore without departing from principles of the present invention. Furthermore, a land well is shown for the purpose of illustration, however, it is understood that the invention may also be employed in offshore wells.

FIG. 1 is a view illustrating a production tubing 120 having a safety valve assembly 200 (hereinafter "valve") in accordance with an embodiment of the present invention. The valve 200 is used for controlling the flow of fluid in a production tubing 120. The valve 200 may be moved between an open position and closed position by operating a controller 150, such as a pump, which may draw from a reservoir 155, in communication with the valve 200 through a control line 145A. When actuated, the controller 150 will exert a control pressure $P_C$ through the control line 145A to the valve 200. Due to vertical height of the control line 145A, a hydrostatic pressure $P_H$ will also be exerted on the valve 200 through the control line. A balance line 145B is also provided to valve 200. The balance line 145B provides fluid communication between the reservoir 155 and the valve 200, thereby maintaining the outlet of the balance line 145B connected to the valve 200 at the hydrostatic pressure $P_H$. An inside of the valve 200 is also exposed to a tubing pressure $P_T$ which may vary with conditions within the wellbore 100. The operation of the valve assembly 200 will first be described generally with respect to FIG. 1, thereafter more specifically with FIGS. 2-5.

The wellbore 100 has been lined with a string of casing 105. A plurality of perforations 110 has been disposed through the casing 105, thereby establishing fluid communication between a formation 115 and the production tubing 120. Thereafter, the production tubing 120 with the safety valve 200 disposed therein is deployed in the wellbore 100 to a predetermined depth. Next, the production tubing 120 is secured in the wellbore proximate a desired zone of interest or a formation 115. Hydrocarbons (illustrated by arrows) flow into the production tubing 120 through the safety valve 200, through a valve 135, and out into a flow line 130. The flow of hydrocarbons may be stopped at any time during the production operation by switching the valve assembly 200 from the open position to the closed position as will be described in more detail in the following paragraphs.

Figure 2:
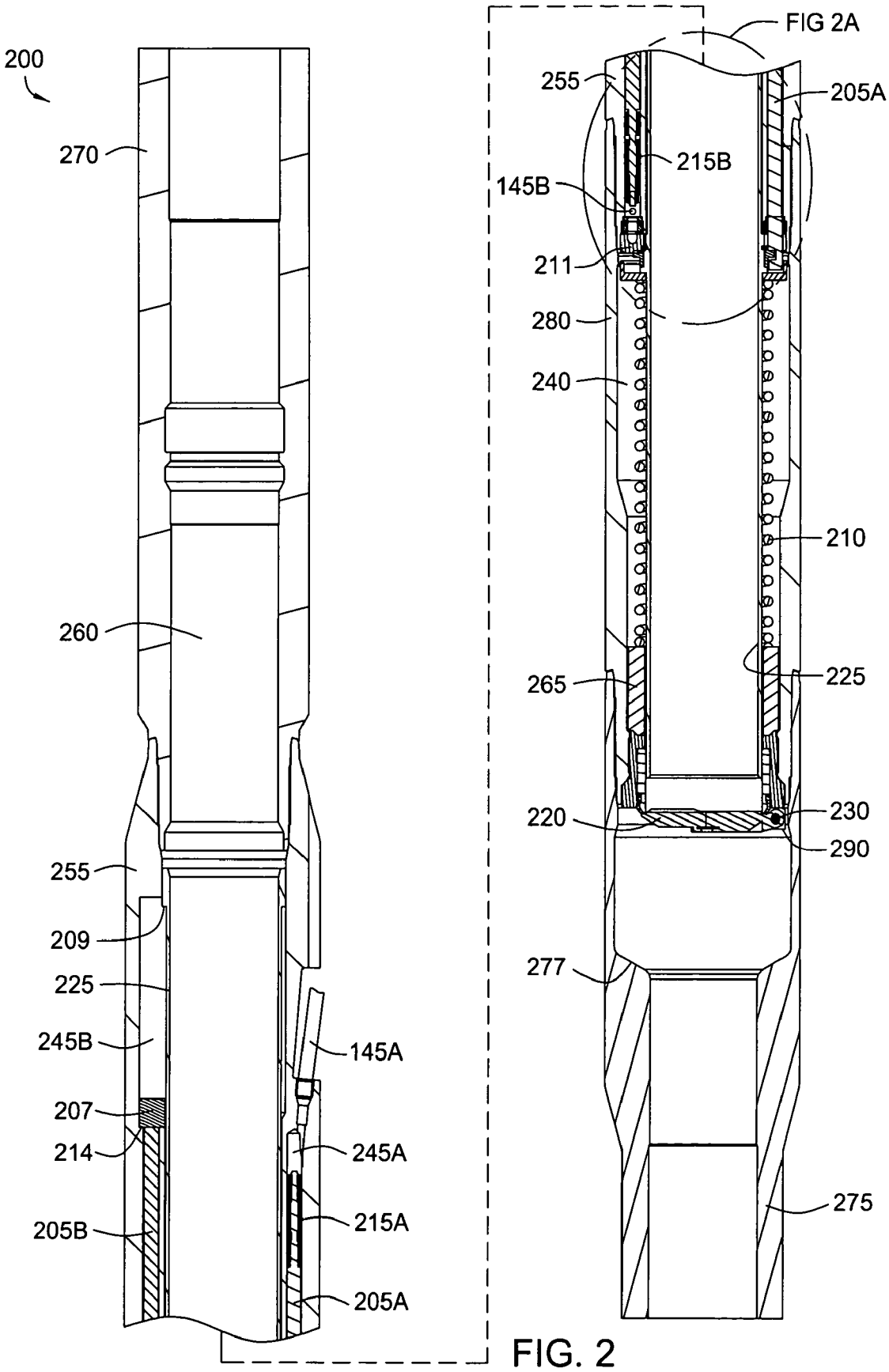
FIGS. 2 and 2A are cross-sectional views illustrating the valve assembly 200 in a first closed position, where the balance piston is idle.
Figure 2A:
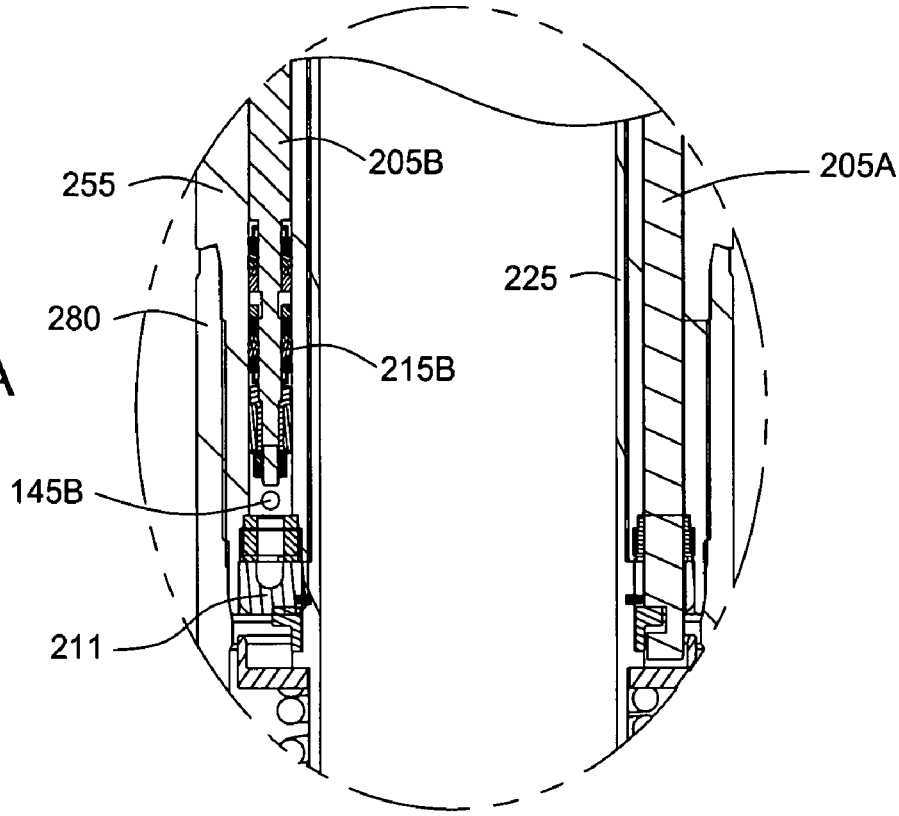

FIGS. 2 and 2A are cross-sectional views illustrating the valve 200 in a closed position, where a balance piston 205B is idle. A bore 260 in the valve 200 allows hydrocarbons to flow up through the valve assembly 200 during the production operation, as discussed in a previous paragraph. The valve assembly 200 includes a top sub 270 and a bottom sub 275 to sealingly connect the valve 200 to the production tubing (not shown).

The valve 200 further includes a chamber housing 255 disposed adjacent the top sub 270 and a spring housing 280 coupled to the chamber housing 255. An annulus 240 is formed between the spring housing and a flow tube 225. The chamber housing 255 includes a control chamber 245A and a balance chamber 245B. An upper end of the control chamber 245A is in fluid communication with the control line 145A and a lower end of the balance chamber 245B in fluid communication with the balance line 145B (only a port shown for the line, line not shown in this view). Routing of a passage through the chamber housing 255 from the balance line 145B to the balance chamber 245B may be accomplished in several ways and is not shown as it would be well within one of ordinary skill in the art. Disposed in the control chamber 245A is a control piston 205A. The control piston 205A is movable between an upper position and a lower position in response to control pressure $P_C$ in the upper end of the control chamber 245A. A seal assembly 215A is disposed on an upper end of the control piston 205A to isolate the upper end of the control chamber 145A. The lower end of the control piston 205A is exposed to pressure $P_T$ within the valve assembly 200.

Disposed in the balance chamber 245B is the balance piston 205B. The balance piston 205B is movable between a lower position and an upper position in response to hydrostatic pressure $P_H$ in the balance chamber 245B. A seal assembly 215B is disposed on a lower end of the balance piston 205B to isolate the lower end of the balance chamber 245B. A cap 211 is coupled to the chamber housing 255 to form a bottom of the balance chamber 245B. A block 207 is coupled to an upper end of the balance piston 205B to mate with a shoulder 214 of the chamber housing 255 and a shoulder 209 of the flow tube 225 (see FIGS. 3 and 4). An upper end of the balance piston is exposed to the tubing pressure $P_T$ within the valve 200. Preferably, the balance chamber 245B is tangentially located proximate to the control chamber 245A, however, the balance chamber 245B may also be located tangentially distal from the control chamber 245A.

As illustrated in FIG. 2, the valve 200 includes a biasing member 210, such as a coil spring, disposed in the annulus 240. A lower end of the biasing member 210 abuts a spacer bearing 265 that is coupled to the spring housing 280. An upper end of the biasing member 210 abuts a shoulder of the flow tube 225, which is coupled to the control piston 205A. In this respect, the movement of the control piston 205A from the upper position to the lower position compresses the biasing member 210 against the spacer bearing 265 (see FIG. 3).

Disposed below the spacer bearing 265 is a flapper 220. The flapper 220 is rotationally attached by a pin 230 to a flapper mount 290. The flapper 220 may move between an open position and a closed position in response to movement of the flow tube 225. In the open position (see FIG. 3), a fluid pathway is created through the bore 260, thereby allowing the flow of fluid through the valve assembly 200. Conversely, in the closed position, the flapper 220 blocks the fluid pathway through the bore 260, thereby preventing the flow of fluid through the valve assembly 200. The flapper 220 is biased towards a closed position by a flapper spring (not shown). For the sake of simplicity and brevity, the flapper spring will not be further discussed.

Further illustrated in FIG. 2, the flow tube 225 is disposed adjacent the flapper 220. As discussed above, the flow tube 225 is coupled to the control piston 205A. In this respect, the movement of the control piston 205A in response to the control pressure $P_C$ in the control chamber 245A also causes the flow tube 225 to move. The functions of the flow tube 225 are to hold the flapper 220 open and to minimize the potential of contaminants, such as solid particulates, from eroding critical workings of the valve assembly 200, such as the flapper seat. As with the control piston 205A, the flow tube 225 is movable between an open position and a closed position. In the open position, the flow tube 225 blocks the movement of the flapper 220, thereby causing the flapper 220 to be maintained in the open position. The flow tube 225 in the closed position on the other hand allows the flapper 220 to rotate on the pin 230 and move to the closed position.

Figure 3A:
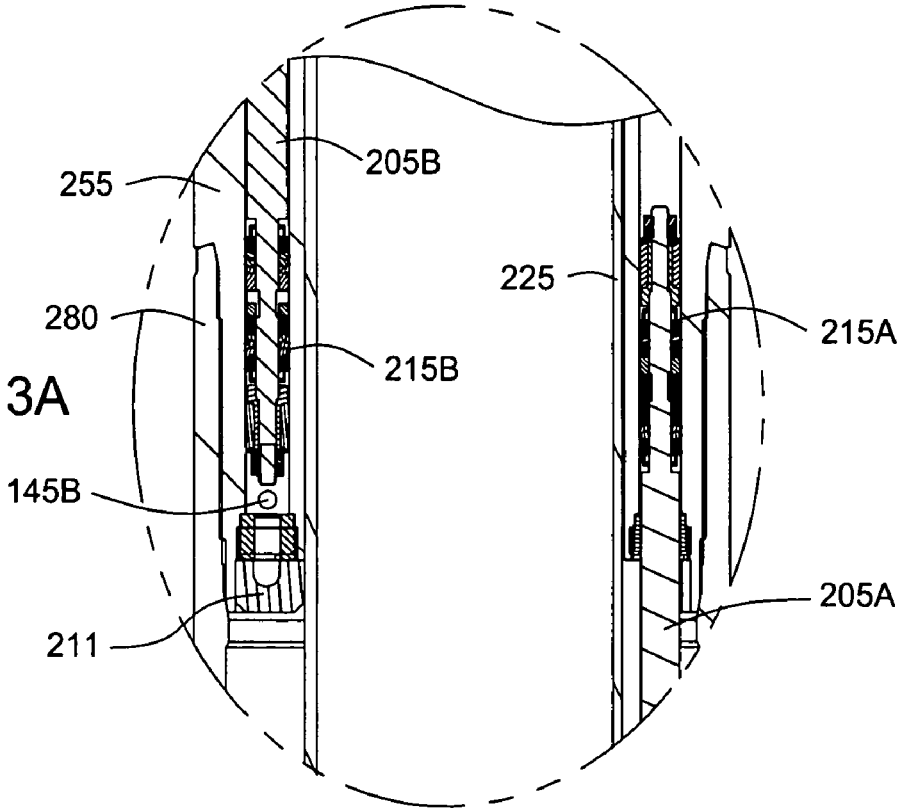
FIGS. 3 and 3A are cross-sectional views illustrating the valve in the open position.
Figure 3:
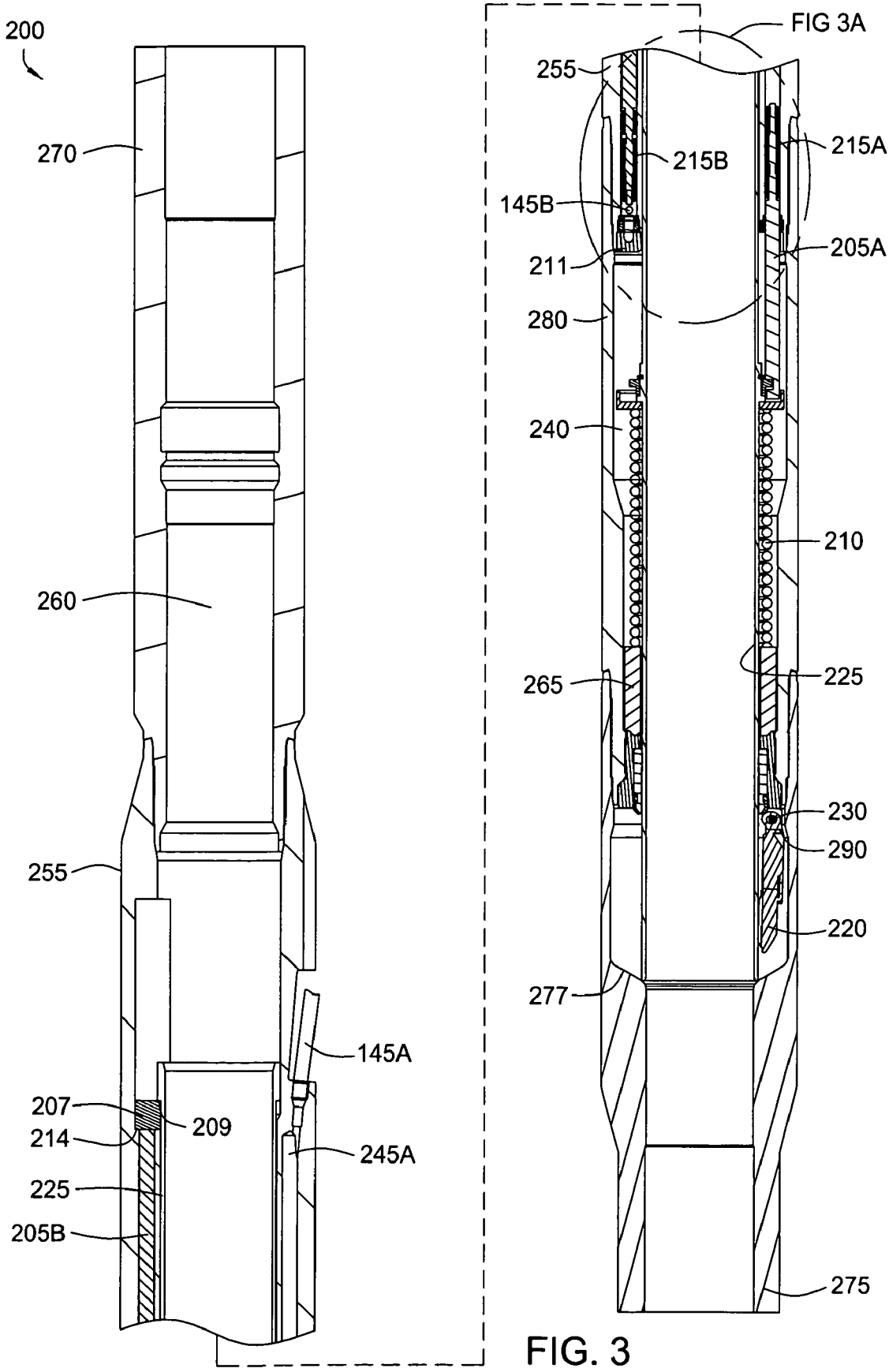

FIGS. 3 and 3A are cross-sectional views illustrating the valve 200 in the open position. Typically, the flow tube 225 remains in the open position throughout the completion operation and the production. The flow tube 225 moves to the open position as the control piston 205A moves to the lower position and compresses the biasing member 210 against the spacer bearing 265. Neglecting pressure $P_T$ within the valve 200 and hydrostatic pressure $P_H$ in the lines 145A,B, controller 150 causes fluid from the control line 145A to enter the control chamber 245A, thereby creating the control pressure $P_C$ on the control piston 205A. As more fluid enters the control chamber 245A, the hydraulic pressure continues to increase until the force exerted by the hydraulic pressure on the upper end of the control piston 205A becomes greater than an opposite force on the lower end of the piston assembly 205 created by the biasing member 210. At that point, the force exerted by the hydraulic pressure in the control chamber 245A causes the control piston 205A to move to the lower position. Since the flow tube 225 is coupled to the control piston 205A, the movement of the control piston 205A causes the movement of the flow tube 225. In this manner, the flow tube 225 is moved to the open position.

For the sake of simplicity, and for further discussion of the operation of the valve 200, the tubing pressure $P_T$ within the valve 200 will be assumed to be equal to the pressure on an underside of the flapper 220 when the flapper 220 is closed so that there is no pressure difference across the flapper 220.

Figure 4:
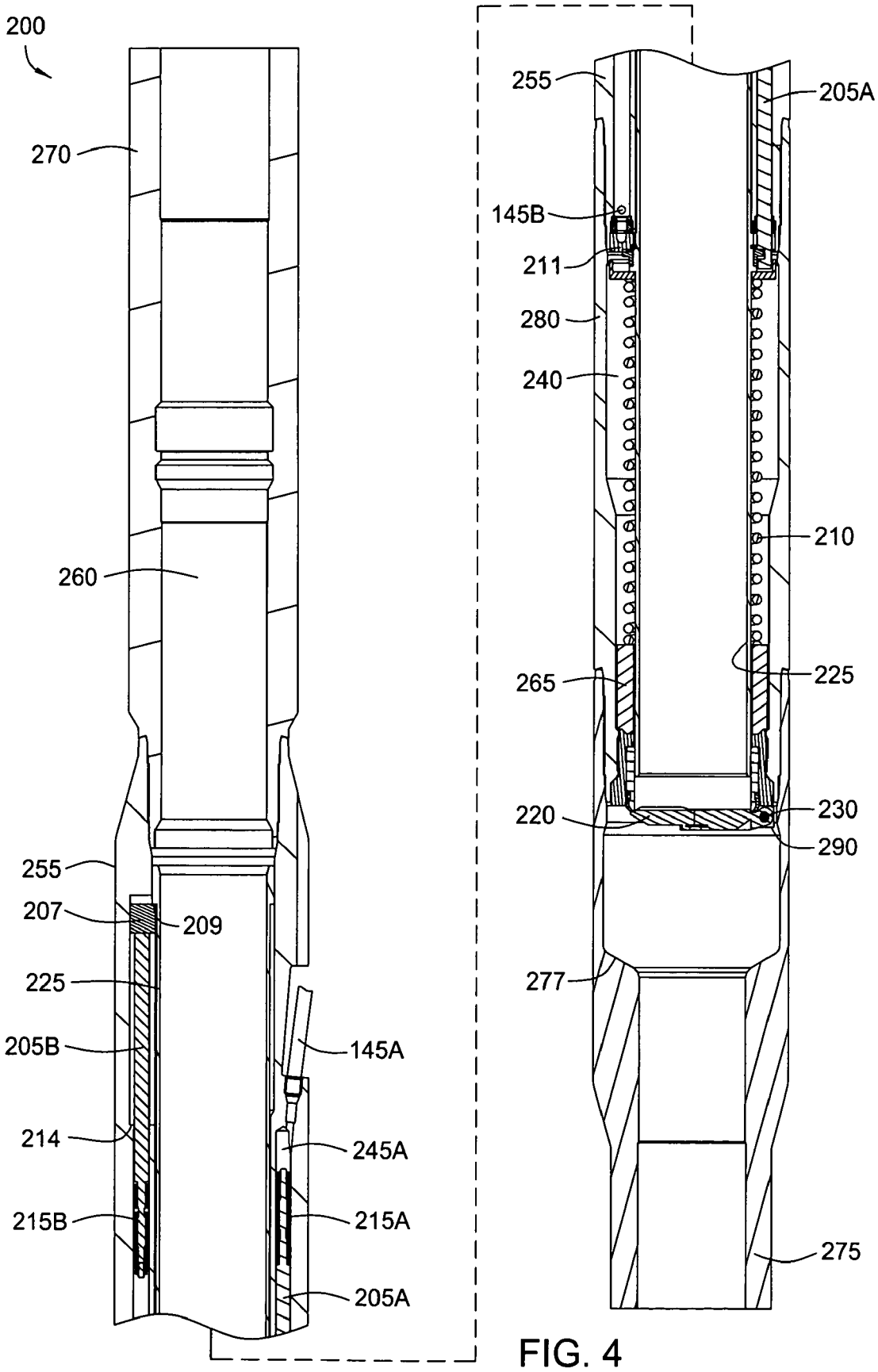
FIG. 4 is a cross-sectional view illustrating the valve in a closed position, where the balance piston is active.

FIG. 4 is a cross-sectional view illustrating the valve assembly 200 in a closed position, where the balance piston 205B is active. Neglecting pressure $P_T$ within the valve assembly 200 and hydrostatic pressure $P_H$ in the lines 145A, B, when controller 150 is shut off or bypassed, fluid in the control chamber 245A exits into the control line 145A, thereby decreasing the hydraulic pressure on the control piston 205A. As more fluid exits the control chamber 245A, the hydraulic pressure continues to decrease until the force exerted by the hydraulic pressure on the upper end of the control piston 205A becomes less than the opposite force on the lower end of the control piston 205A. At this point, the force created by the biasing member 210 causes the flow tube 225 to move to the closed position. Since the control piston 205A is coupled to the flow tube 225, the movement of the flow tube 225 also causes the movement of control piston 205A to the upper position.

Figures 5A, 5B, 5C:
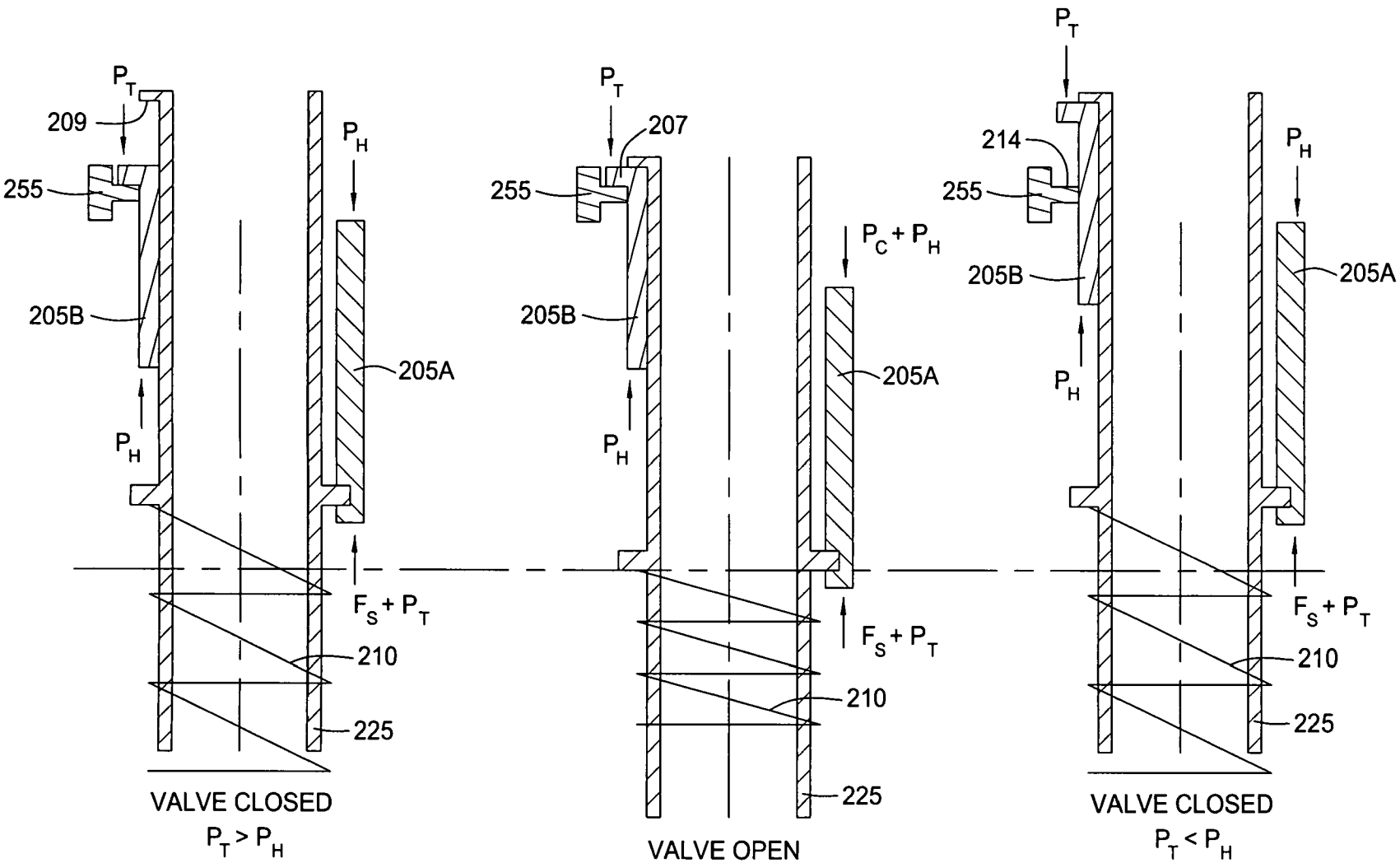
FIGS. 5A-C are free body diagrams of the valve, which illustrate the three operational positions of the valve: closed, where the balance piston is idle; open; and closed, where the balance piston is active, respectively.

FIGS. 5A-C are free body diagrams of the valve assembly 200, which have been greatly simplified for illustrational purposes. FIGS. 5A-C illustrate the three operational positions of the valve assembly 200: closed, where the balance piston 205B is idle; open; and closed, where the balance piston 205B is active, respectively. Operation of the valve assembly 200 among these three positions will now be discussed for situations where $P_T$ and/or $P_H$ are substantial. It is preferred that an area $A_{A1}$ of the control piston 205A on which the control line pressure $P_C$ acts is substantially equal to an area $A_{B1}$ of the balance piston 205B on which the hydrostatic pressure $P_H$ acts; however, $A_{B1}$ may be substantially greater than $A_{A1}$ or the entire cross sectional area of the balance piston 205B may be larger than that of the control piston 205A. It is also preferred that an area $A_{A2}$ of the control piston 205A on which the tubing pressure $P_T$ acts be substantially equal to $A_{A1}$ and an area $A_{B2}$ on which the tubing pressure $P_T$ acts be substantially equal to $A_{B1}$. For the following analysis, it will be assumed that these four areas are equal.

FIG. 5A is a free body diagram of the valve assembly 200 in the closed position, where the balance piston 205B is idle ($P_T>P_H$, see also FIG. 2). As discussed above, when the hydrostatic pressure $P_H$ is substantial, it will place a downward force on the control piston 205A, thereby tending to open the valve assembly 200. When the tubing pressure $P_T$ is substantial, it, along with the biasing member 210 (the force of which is denoted by $F_S$), will place an upward force on the control piston 205A, thereby tending to close the valve assembly 200. Conversely, the hydrostatic pressure $P_H$ will exert an upward force on the balance piston 205B, thereby tending to close the valve 200. Additionally, the tubing pressure $P_T$ will exert a downward force on the balance piston 205B, however, this force does not tend to open the valve assembly 200 because the balance piston 205B is structurally isolated from the flow tube 225 (and the biasing member 210) by interaction of the block 207 with the shoulder 214 of the chamber housing 255. Thus, in this situation, the balance piston 205B can never aid in opening the valve assembly 200. Since the tubing pressure $P_T$ is greater than $P_H$ in this Figure, the balance piston 205B is idle as it exerts no force on the flow tube 225 because a net downward force exerted by the tubing pressure $P_T$ keeps the balance piston 205B resting on the shoulder 214.

FIG. 5B is a free body diagram of the valve 200 in an open position (see also FIG. 3). To open the valve from the closed position, where the balance piston 205B is idle, the control pressure $P_C$ is exerted on the control piston 205A as discussed above. However, additional consideration of the tubing pressure $P_T$ and the hydrostatic pressure $P_H$ changes the analysis from the simplified analysis discussed above. The force exerted by the control pressure $P_C$ that will be applied to open the valve will now have to overcome the force generated by the tubing pressure $P_T$ as well as the force $F_S$ generated by the biasing member 210 to open the valve but will be supplemented by the force exerted by the hydrostatic pressure $P_H$ when the balance piston 205B is idle ($P_T>P_H$).

FIG. 5C is a free body diagram of the valve assembly 200 in a closed position where the balance piston 205B is active ($P_T<P_H$, see also FIG. 4). Since the tubing pressure $P_T$ is less than the hydrostatic pressure $P_H$, the balance piston 205B is active as a net (the upward force exerted on the balance piston 205B by $P_H$ less the downward force exerted by $P_T$) upward force on the balance piston 205B will unseat the balance piston 205B from the shoulder 214 of chamber housing 255 and mate with the shoulder 209 of the flow tube 225, thereby tending to close the valve assembly 200. Summation of the external forces acting on the flow tube 225 and cancellation of redundant terms will conclude that the only net force acting on the flow tube 225 is the force $F_S$ generated by the biasing member 210. Therefore, the undesirable effect of the hydrostatic pressure $P_H$ exerting a downward force on the control piston 205A, thereby tending to open the valve, is removed or negated.

To open the valve from the closed position, where the balance piston 205B is active, the control pressure $P_C$ is exerted on the control piston 205A as discussed above. The force exerted by the control pressure $P_C$ that will be applied will now have to overcome only $F_S$ to open the valve but without the aid of the hydrostatic pressure $P_H$ (since it is effectively cancelled by the activity of the balance piston 205B).

Figure 6A:
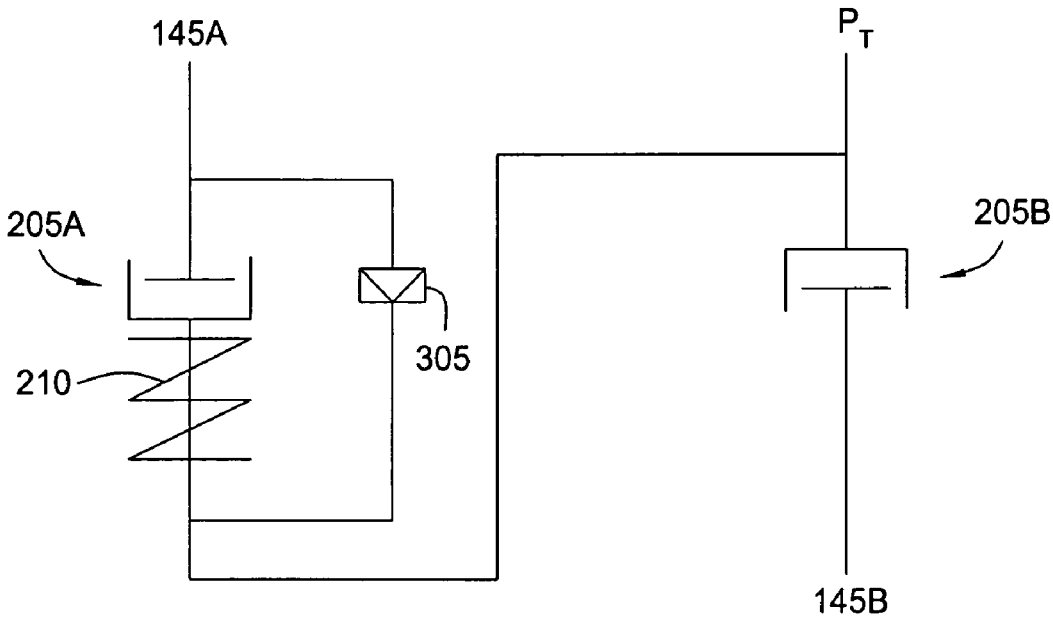
FIGS. 6A and 6B are hydraulic diagrams of alternate embodiments of the valve.
Figure 6B:
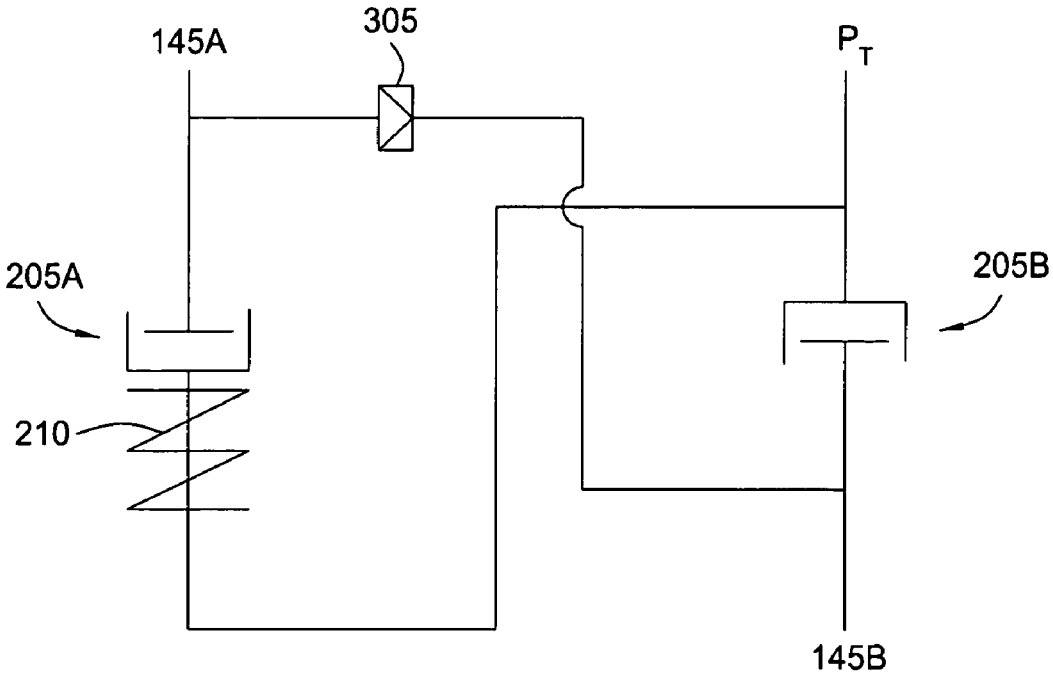

FIGS. 6A and 6B are hydraulic diagrams of alternate embodiments of the valve 200. In both figures, a device 305 enabling manual override of the valve 200, such as a rupture disc or rupture pin has been added to the valve. In the embodiment illustrated in FIG. 6A, the override device 305 is disposed between the control line 145A and a port (not shown) in fluid communication with the bore 260 of the valve. In the embodiment illustrated in FIG. 6B, the override device 305 is disposed between the control line 145A and the balance line 145B. In both embodiments, the inlet side of the override device 305 is in fluid communication with the control line 145A. Both embodiments address the contingency of failure of the balance piston seal assembly 215B. The actuation pressure of the override device 305 may be set significantly above the operating pressure of the control line 145A, to avoid unintentional actuation. In the event of balance seal assembly 215B failure, the control line pressure $P_C$ may be increased to actuate the override device 305.

In the embodiment of FIG. 6A, actuation of the device 305 will cause the control line 145A to be in fluid communication with the bore 260 of the valve 200. Once the device 305 has actuated, the control pressure $P_C$ may be removed. The column of fluid in control line 145A will then flow into the bore 260 of the valve 200 until the pressure in the control line 145A is equal to the tubing pressure $P_T$, thereby closing the valve. Similarly, in the embodiment of FIG. 6B, actuation of the device 305 will cause the control line 145A to be in fluid communication with the balance line 145B. The column of fluid in control line 145A will then flow around the balance piston 205B into the bore 260 until the pressure in the control line 145A is equal to the tubing pressure $P_T$, thereby closing the valve.

In another alternative embodiment of the valve 200, the balance piston 205B would be modified to receive a second seal assembly between the balance seal assembly 215B and the block 207. This would create an intermediate pressure chamber between the two seal assemblies. A port would be provided to this pressure chamber and the port would be connected to the control line 145A. This would create a "fail safe" valve. The failure of balance seal assembly 215B would then be of little consequence to valve closure since the intermediate pressure chamber would be at the hydrostatic pressure $P_H$ when attempting to close the valve 200. Failure of the second seal assembly would have a similar result to actuation of the override device 305 in the embodiment of FIG. 6A. Failure of both seal assemblies would have a similar result to actuation of the override device 305 in the embodiment of FIG. 6B.

In yet another alternative embodiment of the valve 200, a plurality of balance pistons would be included in the event of failure of one of the balance pistons. Additional balance lines could be run in with the valve or the additional balance pistons could be connected to the single balance line with bypass valves.

In yet another alternative embodiment of the valve 200, the cross sectional area of the balance piston 205B is larger than that of the control piston 205A and the biasing member 210 is removed. The greater closing force of the larger balance piston compensates for the missing force generated by the biasing member 210.

Although the invention has been described in part by making detailed reference to specific embodiments, such detail is intended to be and will be understood to be instructional rather than restrictive. It should be noted that while embodiments of the invention disclosed herein are described in connection with a subsurface safety valve assembly, the embodiments described herein may be used with any well completion equipment, such as a packer, a sliding sleeve, a landing nipple and the like.

While the foregoing is directed to embodiments of the present invention, other and further embodiments of the invention may be devised without departing from the basic scope thereof, and the scope thereof is determined by the claims that follow.

The invention claimed is:

1. A subsurface safety valve, comprising:

a flow tube having a bore therethrough;

a control piston having two sides isolated from each other by a seal assembly and coupled to the flow tube; and a balance piston having two sides isolated from each other by a seal assembly and selectively coupled to the flow tube, wherein:

the valve is configured so that the control piston will receive a control pressure on the first side and the balance piston will receive a hydrostatic pressure on the second side, and the flow tube is actuatable between a first position and a second position and the balance piston is selectively coupled to the flow tube so that the balance piston may urge the flow tube towards the second position but not towards the first position.

2. The safety valve of claim 1, wherein the second side of the control piston is in fluid communication with the flow tube bore.

3. The safety valve of claim 1, wherein the first side of the balance piston is in fluid communication with the flow tube bore.

4. The safety valve of claim 1, further comprising at least one housing, wherein the flow tube, the control piston, and the balance piston are disposed within the housing and the balance piston is selectively coupled to the housing.

5. The safety valve of claim 4, further comprising a flapper coupled to the housing and a flapper spring coupled between the flapper and the housing, wherein the flapper is actuatable by the flow tube between a first position and a second position and the flapper spring biases the flapper in the second position.

6. The safety valve of claim 1, wherein the first side of the control piston has an area $A_1$, the second side of the control piston has an area $A_2$, and $A_1$ is substantially equal to $A_2$.

7. The safety valve of claim 1, wherein the first side of the balance piston has an area $A_3$, the second side of the balance piston has an area $A_4$, and $A_3$ is substantially equal to $A_4$.

8. The safety valve of claim 1, wherein the first side of the control piston has an area $A_1$, the first side of the balance piston has an area $A_3$, and $A_1$ is substantially equal to $A_3$.

9. The safety valve of claim 1, further comprising at least one housing and a biasing member disposed between the flow tube and the housing.

10. A method of using the safety valve of claim 1, comprising:

deploying production tubing with the safety valve disposed therein in a wellbore proximate to a formation; and flowing hydrocarbons from the formation through the production tubing and the safety valve to a surface of the wellbore.

11. The method of claim 10, wherein a control line extends from the surface to a port in communication with the first side of the control piston and a balance line extends from the surface to a port in communication with the second side of the balance piston.

12. A subsurface safety valve, comprising:

a housing having a control port disposed through a wall thereof, and a balance port disposed through the housing wall;

a flow tube disposed in the housing and having a bore therethrough, the flow tube movable between first and second positions;

a control piston:

disposed in the housing, having a first side in communication with the control port and a second side isolated from the first side by a seal assembly, and coupled to the flow tube; and a balance piston:

disposed in the housing, having a second side in communication with the balance port and a first side isolated from the second side by a seal assembly, and movable relative to the flow tube when the flow tube is in the second position.

13. The safety valve of claim 12, wherein the second side of the control piston is in communication with the flow tube bore and the first side of the balance piston is in communication with the flow tube bore.

14. The safety valve of claim 12, wherein the balance piston is movable between active and idle positions when the flow tube is in the second position and the balance piston is longitudinally coupled to the flow tube in the active position and longitudinally coupled to the housing in the idle position.

15. The safety valve of claim 14, wherein the flow tube has a wall and a shoulder is formed in the wall and the balance piston abuts the flow tube shoulder in the active position and a shoulder formed in the housing wall in the idle position.

16. The safety valve of claim 12, further comprising a flapper coupled to the housing and a flapper spring coupled between the flapper and the housing, wherein the flapper is movable by the flow tube to an open position and movable by the flapper spring to a closed position.

17. The safety valve of claim 12, wherein:

the housing further has a bore therethrough, the housing further has a control chamber formed in the housing wall and in communication with the control port, the housing further has a balance chamber formed in the housing wall and in communication with the balance port, the control piston is at least partially disposed in the control chamber, and the balance piston is disposed in the balance chamber.

18. The safety valve of claim 12, further comprising a biasing member disposed between the flow tube and the housing, wherein the biasing member is longitudinally coupled to the housing and the flow tube.

19. A method of using the safety valve of claim 12, comprising:

deploying production tubing with the safety valve disposed therein in a wellbore proximate to a formation; and flowing hydrocarbons from the formation through the production tubing and the safety valve to a surface of the wellbore.

20. The method of claim 19, wherein a control line extends from the surface to the control port and a balance line extends from the surface to the balance port.

* * * * *